US006145255A

United States Patent [19]

Allaster

[11] Patent Number: 6,145,255

[45] Date of Patent: Nov. 14, 2000

[54] SOFFIT VENT

[75] Inventor: George G. Allaster, Clearwater, Fla.

[73] Assignee: Building Materials Corporation of America, Wayne, N.J.

[21] Appl. No.: 09/382,879

[22] Filed: Aug. 25, 1999

Related U.S. Application Data

[62] Division of application No. 09/065,470, Apr. 23, 1998.

[51] Int. Cl.[7] ..... E04B 7/02

[52] U.S. Cl. ..... 52/95; 52/94; 52/302.1

[58] Field of Search ..... 52/95, 94, 302.1

[56] References Cited

U.S. PATENT DOCUMENTS

| | | | |
|---|---|---|---|
| 3,160,987 | 12/1964 | Pinkley | 52/94 |
| 3,174,421 | 3/1965 | Gray | 52/95 |
| 3,256,654 | 6/1966 | Pinckney | 52/95 |
| 4,184,416 | 1/1980 | Koontz | 98/37 |
| 4,660,463 | 4/1987 | Bottomore et al. | 98/37 |
| 4,762,053 | 8/1988 | Wolfert | 98/37 |
| 4,776,262 | 10/1988 | Curran | 52/97 |
| 5,238,450 | 8/1993 | Rotter | 52/94 |
| 5,328,406 | 7/1994 | Morris et al. . | |
| 5,425,672 | 6/1995 | Rotter . | |
| 5,560,157 | 10/1996 | Rotter . | |
| 5,996,289 | 6/1966 | Allaster | 52/95 |

*Primary Examiner*—Carl D. Friedman
*Assistant Examiner*—Phi Dieu Tran A
*Attorney, Agent, or Firm*—Imre Balogh; William J. Davis

[57] ABSTRACT

Soffit ventilation system in a building having a horizontal soffit with a plurality of vents and a strip of mat of randomly oriented synthetic fibers covering the attic-facing side of the soffit. An alternative embodiment has a panel of air-impermeable material having upper and lower sections. The strip of mat of randomly oriented synthetic fibers is sandwiched between the lower section and the vertical side of the walls allowing the passage of air into the attic through an opening between the lower section and the upper section of the air-impermeable panel.

7 Claims, 3 Drawing Sheets

SOFFIT VENT

This is a division, of application Ser. No. 09/065,470, filed Apr. 23, 1998.

BACKGROUND OF THE INVENTION

1. Field of the Invention

This invention relates generally to a soffit ventilation system which provides for proper venting of a building having an attic, prevents insects and environmental elements, such as water and snow, from entering the attic through the ventilator and can be tailor-made to a variety of pre-existing and newly constructed buildings.

2. Reported Developments

Soffit ventilators are perforated, louvered or baffled vent openings in the underside of the eaves of an overhanging roof or the facia covering the ends of roof rafters when the roof has no soffit or has very narrow soffit. The vent openings allow outside air to flow into the attic to equalize the interior attic temperature and pressure with that of the outside environment. This equalization helps to prevent degradation of the roof structure, reduces the accumulation of condensation in the insulating material covering the floor of the attic thereby increasing the efficacy of heating/cooling of the living space in the building covered by the roof structure.

The soffit ventilator system of the prior art is typically used in conjunction with a roof ridge ventilator overlying the open roof along the length of the roof for exhausting the air from the space below the roof and the ceiling of the attic, i.e., as the air entering the attic through the soffit vent mixes with the warmer air in the attic, it has to be expelled through an opening in the roof ridge where the lighter, warmer air accumulates. Desirably, the volume of air intake through the soffit ventilator should be balanced by the volume of air exhaust through the roof ridge ventilator. In an optimum soffit ventilator/roof ridge ventilator system there is a balance between the net free open area presented by such system. The terminology "Net Free Open Area" or NFA means the cross-sectional area of a ventilator system which is open for passage of air therethrough. This balance of the net free open area of a soffit ventilator and roof ridge ventilator is difficult to achieve. Thus in many existing and newly built buildings there tend to be an out of balance soffit/roof ridge ventilation system.

Ventilation systems should also provide against insects entering into the attic space of buildings. While large perforations in the soffit and roof ridge ventilation panels would render the desired flow of air through the attic space, they would also allow ingress to insects therein to form insect colonies. Insects typically enter into the attic through the soffit vents. The prior art for this and other reasons provides synthetic air-permeable barriers over the perforations or louvers such as disclosed in U.S. Pat. No. 5,238,450. However, this system allows insect ingress through the perforations or louvers into the space between the perforations or louvers and the air-permeable barrier mat wherein they can nest and form insect colonies.

The prior art has also provided for ventilation by placing synthetic fiber matting constructed of randomly-aligned synthetic fibers which are joined by phenolic or latex binding agents and heat cured to provide an air-permeable mat placed over the opening of the roof ridge. Such system provides for preventing insect ingress through the roof ridge vent but does not prevent ingress by insects through the soffit vent system.

U.S. Pat. No. 5,328,406 discloses a fascia ventilator and drip edge comprising:

a panel having an upper and a lower section; the upper section being disposed on the roof structure, and the lower section attached to the vertical wall structure in a horizontally-spaced position;

lip structure carried on the lower section;

a baffle member engageable with the lip structure, the baffle member having a pair of spaced baffle walls extending parallel to the lower section and providing passage means for directing air flow upwardly, whereby air can pass upwardly between the lower section and the vertical wall structure toward an opening above the vertical wall structure.

The invention does not appear to provide prevention of insect ingress into the attic space.

U.S. Pat. No. 5,560,157 discloses a fascia vent for ventilation of vapors from the attic of a building structure. The fascia is secured to the outer end of the roof rafters and at least one portion of the fascia is spaced from the outer ends of the rafters. An air permeable and resilient strip is interposed between the fascia and the outer ends of the rafters to provide for the flow of vapor therebetween and into the attic.

The air-permeable and resilient strip is not placed on, or supported by, a louver or baffle to hold the strip in place, but it is secured to the end of the rafters by adhesives or nails.

Although the resilient strip prevents ingress to insects, it restricts the flow of outside air into the attic since outside air can only enter into the strip through the gap between the fascia and the strip or through the narrow underside of the strip. The fascia board positioned over the strip also tends to either compress the strip against the rafters, or provide inadequate support for the strip if a wider gap is maintained between the fascia and the strip.

The object of the present invention is to provide an improved soffit ventilation system which together with an appropriate roof ridge vent solves the problems described above.

SUMMARY OF THE INVENTION

The present invention utilizes a vent material of randomly oriented synthetic or natural fibers which are joined by polymeric materials and heat cured to render the synthetic fibers air-permeable with varying mesh sizes. The synthetic fibers, such as made from nylon, rayon, viscose, cellulose acetate and/or polyester, are randomly aligned into a web. Alternatively, the vent material can be fabricated of nautral fibers such as cellulose fibers. The web is oven-cured to bind the fabrics into a mat having intestices therein to allow air flow therethrough. Polymeric materials for bonding the synthetic fibers together include copolyester elastomers, ethylene methacrylate, ethylene vinyl acetate, ethylene vinyl alcohol, polyethylene and polypropylene. The average diameter of the intestices between the randomly oriented fibers can be of from about 0.2 mm to about 5 mm and preferably about 1 mm. The thickness of the mat typically is of from about 0.5 to 3 inches. The air-permeable mat is cut into strips the length and width of which is determined by the length and width of the soffit in which the strip will be used. Preferred polymeric material for bonding the synthetic fibers is polyvinyl chloride. U.S. Pat. No. 5,167,579 discloses air-permeable resilient materials being used in ridge vent which is incorporated herein by reference.

In one embodiment of the present invention a soffit ventilating system is provided in a building comprising:

vertical side walls; and sloping roof extending outwardly and beyond the vertical side walls and forming eaves over said vertical side walls. The eaves comprising a horizontal soffit and a vertical face plate. A plurality of vents is provided in the horizontal soffit which on the inside, the side facing the attic, is covered by a strip of mat of randomly oriented synthetic fibers. The strip of mat conforms to the inside of the soffit, leaving no gap therebetween so that if insects pass through the vents in the soffit, they would not be able to nest between the soffit and the strip of mat.

In another embodiment a soffit ventilation system is provided in a building in which the building comprises:

vertical side walls; and sloping roof extending outwardly and beyond the vertical side walls and forming eaves over said vertical side walls.

The attic space is enclosed between the sloping roof and the internal ceiling. A gap or opening is provided between the sloping roof structure and the vertical side walls so as to allow flow of outside air into the attic space.

The soffit ventilating system comprises:

a panel of air-impermeable material having an upper section and a lower section. Preferably, the two sections are integral, however, they may be separate sections joined together by hinges or other means. The upper sections runs parallel with, and underneath, the sloping roof structure while the lower section runs parallel with the vertical side walls. At the junction of the two sections they form a bend of a generally U-shaped configuration the peak of which faces the outside and serves as a drip edge to direct moisture, such as rain and snow, flowing down the sloping roof away from the vertical side walls. Typically, the drip edge drops the moisture into a gutter attached to the lower section of the air-impermeable panel positioned just under the drip edge.

To prevent ingress of insects into the attic space, yet allow for proper ventilation thereof, a strip of mat of randomly oriented fibers or of open cell foam is sandwiched between the lower panel section and the vertical side walls. The strip of mat may be adhesively attached to the lower panel section prior to installation or pre-attached to the panel by the manufacturer. The panel, along with the strip, is then nailed and/or stapled to the top portion of the horizontal wall of the building. The top portion of the wall preferably has a face plate to affix the panel/strip combination of the present invention.

BRIEF DESCRIPTION OF THE DRAWINGS

FIG. 1 is a vertical section of a portion of a building showing the relationship of the soffit vent system of the present invention to the building;

FIG. 2 shows a vertical section of the perforated soffit and a strip of randomly oriented synthetic fibers laid on top, and conforming to, the perforated soffit on the inside or attic side thereof;

FIG. 3 shows a vertical section of a building in which the facia ventilator comprising a strip or randomly oriented synthetic fibers of the present invention is mounted between a face plate and a solid plastic side panel parallel with the face plate;

FIG. 4 shows a front view of the strip attached to the solid plastic side panel;

FIG. 5 shows a back view of the strip attached to the solid plastic side panel; and FIG. 6 shows two units of the strips attached to solid plastic side panels having a pair of tongue and groove which facilitate joining one unit to the other unit in an end-to-end relationship.

DETAILED DESCRIPTION OF THE INVENTION

Figure 1:
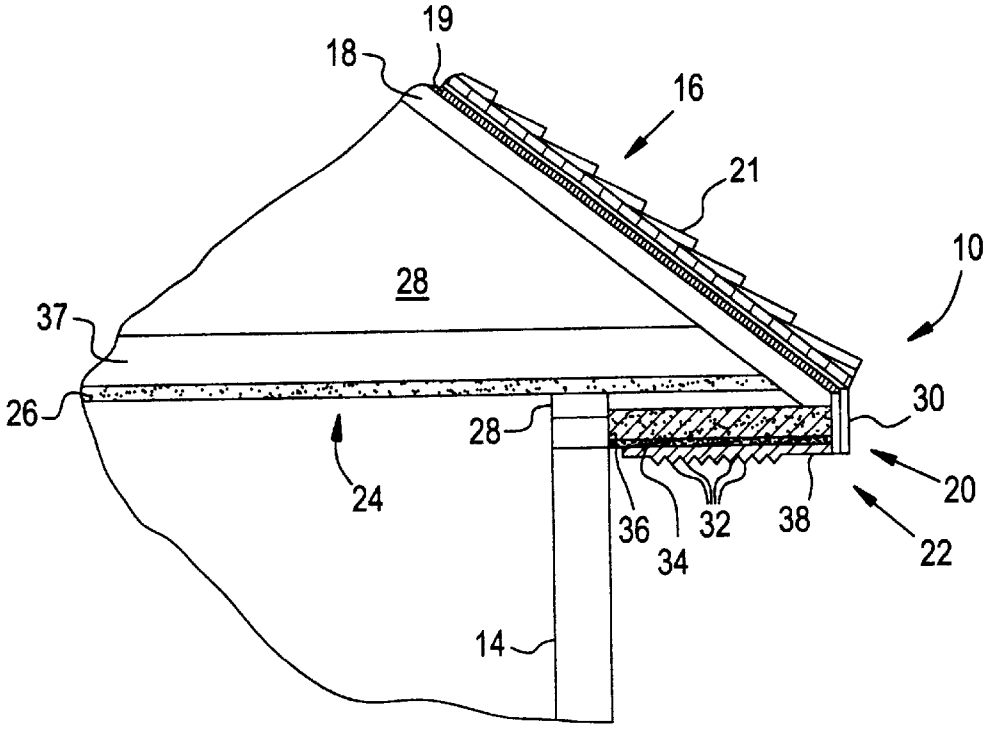
FIGS. 1 and 2 show one embodiment and FIGS. 3–6 show another embodiment of the present invention.

Referring to one embodiment of the present invention, FIG. 1 shows a vertical section of a portion of a building 10 which is ventilated by the soffit vent of the present invention. The portion of the building shown comprises: vertical side walls 14; sloping roof 16 comprising a plurality of rafters 18 and covered by plywood 19 which in turn is covered by roof shingles 21, extending outwardly beyond side walls 14; eaves 20 formed by sloping roof 16 and vertical side walls 14; soffit 22 in the underside of the eaves 20; ceiling 24 comprising a plurality of parallel joists 26 covered by plywood 27; attic space 28 enclosed by sloping roof 16 and ceiling 24; sill plate 28 on top of vertical side wall supporting the joists 26 and rafters 18; and vertical face plate 30 attached to rafters 18 and plywood 19 covering eaves 20 and protecting the underlying soffit 22 from the elements.

Soffit 22 connected to face plate 30 and vertical side wall 14 comprises a plurality of vents 32 which may be: circular perforations typically having an average diameter of from about 1 to 5 mm; rectangular screen mesh wherein each of the rectangles enclose from about 2 to 10 $mm^2$ of an open area or louvers comprising parallel slots running in the width direction of the soffit and each of the slots typically having an open area of from about 5 to 15 $mm^2$.

Soffit 22 having perforations, screen mesh or louvers therein is covered by a strip 34 of mat comprising randomly oriented synthetic fibers or of open cell foam. The strip conforms to the soffit leaving no space or gap between it and the perforated soffit.

Figure 2:
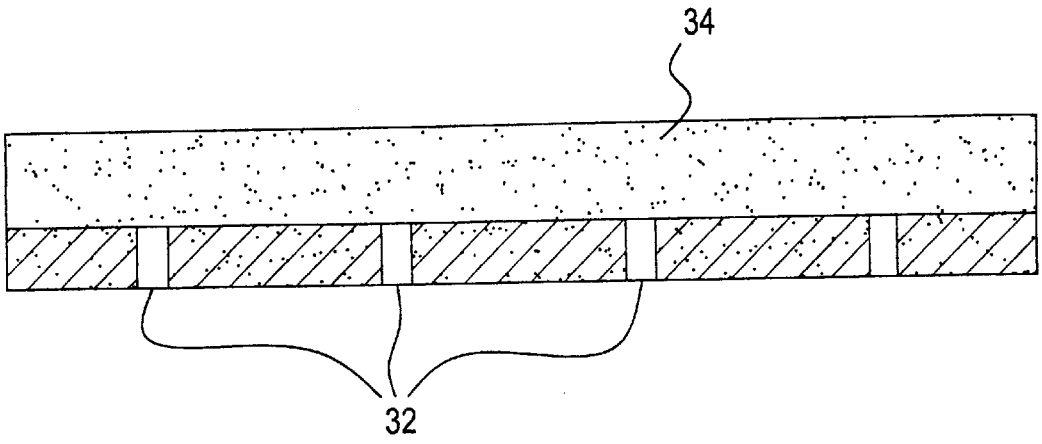

The strip 34 made or cut to the desired width is laid on the inside, attic facing side of the perforated soffit and ordinarily will stay conformed to the perforated soffit as shown in FIG. 2. However, it may be attached by staples or adhesive means as shown at 36 and 38 in FIG. 1. Alternatively, the strip may be attached to the inside of the face plate 30 and the eaves side of the sill plate. If desired, the strip may also be attached to the perforated soffit at random spots using adhesive means, such as thermoplastic means. The soffit vent of the present invention prevents ingress of insects entering into the attic. Even if smaller insects enter through the perforations of the soffit they get trapped in the interstices of the synthetic fiber. Since there is no "dead" space between the strip and the perforated soffit, the insects are prevented to form nests and colonies.

In use, air will enter through perforations 32, enter into the interstices of the strip and travel up into the attic space 28 between rafters 18. Preferably, especially in buildings having large attics, the soffit vent of the present invention will be used in conjunction with a static or dynamic roof ridge venting system to allow exhaust of the air entering through the soffit vent and thereby providing a balanced ventilation system.

Figure 3:
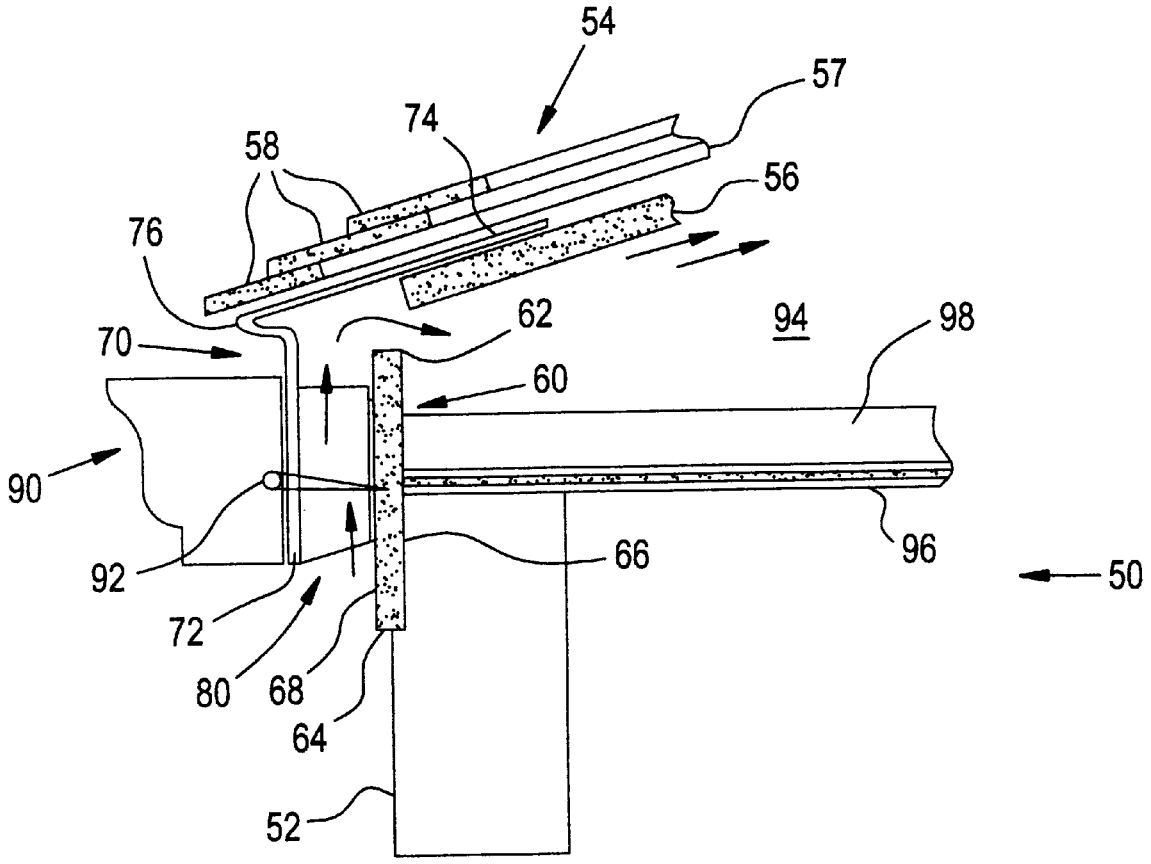

A preferred fascia vent is shown in FIG. 3 which comprises a solid plastic or metal panel and a strip of randomly oriented synthetic fibers covering a portion of the solid panel.

FIG. 3 shows a cross-sectional portion of a building 50 which comprises:

vertical side walls 52 supporting sloping roof 54;

sloping roof 54 comprising: plywood deck 56; storm guard 57 spaced from and positioned over plywood deck 56; and shingles 58 covering storm guard 57;

face plate 60 having a top portion 62, a bottom portion 64, side portion 66 facing vertical side walls 52, and side portion 68 facing away from vertical side walls 541 secured to top portion of vertical side walls and extending upward toward plywood deck 56, wherein there is an opening between plywood deck 56 and top portion 62 of face plate 60;

solid plastic or metal side panel 70 comprising: a lower portion 72 running parallel to face plate 60; upper portion 74 running parallel to sloping roof 54 between said plywood deck 56 and storm guard 57; drip edge 76 formed at the junction of lower portion 72 and upper portion 74;

a strip 80 of randomly oriented synthetic fibers sandwiched between face plate 60 and lower portion 72 of solid plastic side panel 70;

a gutter 90 secured to solid plastic side panel 70 by nails 92 or other suitable means, wherein the securing means extend into the face plate 60 subsequent to penetrating strip 80 of the randomly oriented fibers.

Attic space 94, which is to be ventilated, is defined by ceiling floor board 96, covered by insulation 98 on the attic side thereof.

Upon installation of the fascia vent of the present invention, outside air enters on the lower portion of strip 80 travels through it and enters into attic space 94 as shown by the arrows. The outside air is then mixed with the static warm air in the attic and its exhausts through a ridge vent (not shown).

Figure 4:
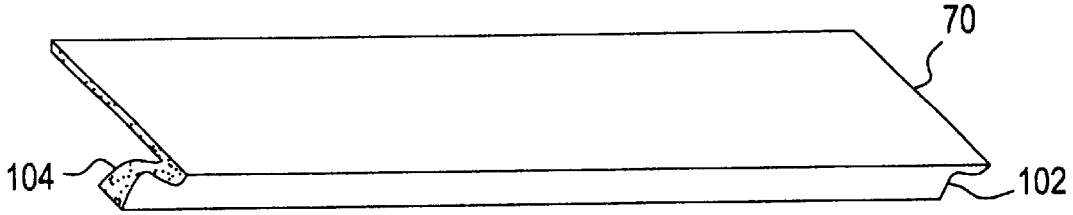
Figure 5:
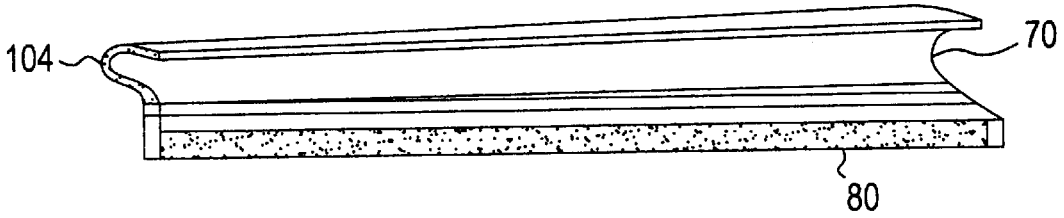
Figure 6:
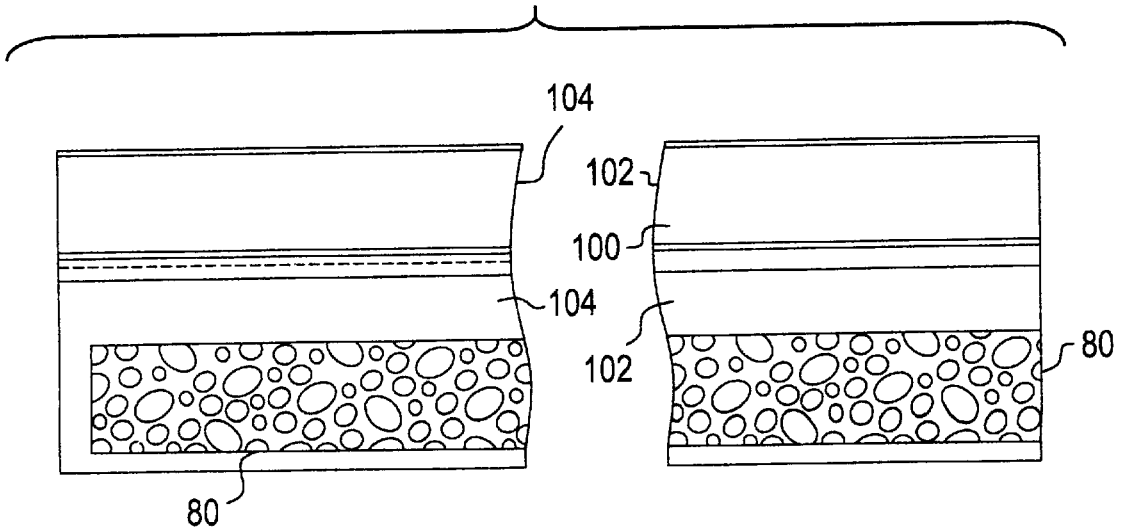

FIGS. 4, 5 and 6 show the details of the strip 80 of the randomly oriented synthetic fibers attached to the solid plastic side panel 70. FIG. 4 shows a front view, facing face plate 68, of strip 80 and FIG. 5 shows a back view of strip 80 facing panel 70, wherein strip 80 is carried by panel 70. Strip 80 is attached to side panel 70 wherein, typically, the strip has a thickness of 1", a width of 3" and a length of 60". The panel 70 has a width of 12" and a length of 60" and is made of a suitable plastic or metal. A preferred plastic is vacuum formed polyvinyl chloride. Other suitable plastics include polyethylene, polypropylene, polyethylene terephthalate and copolymers. It is contemplated that recycled plastics can be used. The panel has a linear end edge 100, a 1" slot or groove at 102 and a 1" tongue at 104. The slots and tongue provide for attaching and partially overlapping one panel to the next upon installation of the panels which carry strip 80.

Upon installation, tongue 104 engages groove 102 to provide for a continuous strip.

The groove/tongue attachment may be accomplished by two-grooves-two tongues engagement in the panels, such as shown in FIG. 6

In preferred embodiments, the soffit ventilating system of this invention exhibits NFA for air passage of at least about 8 square inches per running foot.

The panels can be provided with a suitable end cap fabricated of plastic or metal. In a preferred embodiment, the end cap is fabricated of stamped aluminum and includes three foldable portions for folding over the face, top and undersides of the panel.

Having described the invention with reference to its preferred embodiments, it is to be understood that modifications within the scope of the invention will be apparent to those skilled in the art.

What is claimed is:

1. A soffit ventilating system in a building, said building comprising:

(a) vertical side walls having a top portion; a sloping roof extending outwardly and beyond the vertical side walls forming eaves comprising:

a plurality of rafters covered by a layer of plywood, which in turn is covered by roof shingles;

a ceiling comprising a plurality of parallel joists covered by plywood;

an attic space enclosed by said sloping roof and said ceiling;

a sill plate on the top portion of said vertical side walls supporting said parallel joists; and a vertical face plate attached to said rafters and to said layer of plywood;

(b) a soffit ventilating system in said building comprising:

a soffit covering the underside of said eaves, having an inside face projecting towards said attic space, and an outside face projecting towards the outside environment, attached to said vertical face plate at one end thereof and to said sill plate at the other end thereof, said soffit having a plurality of vents therein allowing outside air to pass therethrough and into said attic space; and a strip of mat of randomly oriented synthetic fibers or foam laid on the inside face of said soffit tightly conforming to said soffit without allowing dead space or gaps between said strip of mat or foam and said soffit, thereby preventing insects to form nests and colonies between said strip of mat or foam and said soffit wherein said strip of mat or foam is attached to said soffit by staples, adhesives or thermoplastics; wherein said randomly oriented synthetic fibers or foam have interstices of from about 0.2 to about 5 mm and the thickness of said mat of randomly oriented fibers or foam is of from about 0.5 inches to about 3 inches.

2. The soffit ventilating system of claim 1 wherein said vents are circular perforations having an average diameter of from about 1 to 5 mm.

3. The soffit ventilating system of claim 1 wherein said vents are rectangular screen meshes wherein each of the rectangles enclose from about 2 to 10 $mm^2$ of an open area.

4. The soffit ventilating system of claim 1 wherein said vents are louvers comprising parallel slots each of which have an open area of 5 to 15 $mm^2$.

5. The soffit ventilating system of claim 1 wherein said strip of mat are randomly oriented fibers bound together with polymeric materials selected from the group consisting of polyester elastomers, ethylene methacrylate, ethylene vinyl acetate, ethylene vinyl alcohol, polyethylene and polypropylene.

6. The soffit ventilating system of claim 1 wherein said randomly oriented fibers of said strip of mat are bound together by polyvinyl chloride.

7. The soffit ventilating system of claim 1 wherein said randomly oriented fibers of said strip of mat are nylon, cellulose, rayon, viscose or polyester fibers.

* * * * *